US006781102B1

(12) United States Patent
Proffitt et al.

(10) Patent No.: US 6,781,102 B1
(45) Date of Patent: Aug. 24, 2004

(54) MICROWAVE FEED SYSTEM FOR A COOKING APPLIANCE HAVING A TOROIDAL-SHAPED WAVEGUIDE

(75) Inventors: Sondra Denice Proffitt, Springfield, TN (US); Robert Z. Whipple, Jr., Louden, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/624,672

(22) Filed: Jul. 23, 2003

(51) Int. Cl.[7] ..... H05B 6/72

(52) U.S. Cl. ..... 219/746; 219/748; 219/750; 219/751; 333/227

(58) Field of Search ..... 219/745–751, 219/695–697; 333/227, 231

(56) References Cited

U.S. PATENT DOCUMENTS

| | | | | |
|---|---|---|---|---|
| 3,104,304 A | | 9/1963 | Sawada | |
| 3,439,143 A | | 4/1969 | Cougoule | |
| 3,746,823 A | | 7/1973 | Whiteley | |
| 4,144,436 A | | 3/1979 | Hauck | |
| 4,196,332 A | | 4/1980 | MacKay et al. | |
| 4,223,194 A | | 9/1980 | Fitzmayer | |
| 4,336,434 A | | 6/1982 | Miller | |
| 4,415,789 A | | 11/1983 | Nobue et al. | |
| 4,446,349 A | | 5/1984 | Smith | |
| 5,451,751 A | | 9/1995 | Takimoto et al. | |
| 5,487,875 A | * | 1/1996 | Suzuki | 422/186.05 |
| 5,728,310 A | * | 3/1998 | Ice et al. | 219/679 |
| 6,657,171 B1 | * | 12/2003 | Huynh et al. | 219/746 |
| 6,667,466 B1 | * | 12/2003 | Whipple, Jr. | 219/746 |

* cited by examiner

*Primary Examiner*—Philip H. Leung
(74) *Attorney, Agent, or Firm*—Diederiks & Whitelaw, PLC

(57) ABSTRACT

A microwave delivery system for a cooking appliance having a cooking chamber includes a toroidal-shaped waveguide, a magnetron, a tubular feed member interconnecting the magnetron with the toroidal-shaped wave guide and a field flux generator positioned about the tubular feed member. The flux field generator shifts a microwave energy field produced by the magnetron in the tubular feed member. The shifted microwave field focuses high energy standing waves that are directed into the toroidal-shaped wave guide and, ultimately, the cooking chamber. The field flux generator produces either magnetic or electrical fields and is driven by a pulsed DC current, a rectified AC current or a pure AC signal energy source.

24 Claims, 2 Drawing Sheets

MICROWAVE FEED SYSTEM FOR A COOKING APPLIANCE HAVING A TOROIDAL-SHAPED WAVEGUIDE

BACKGROUND OF THE INVENTION

1. Field of the Invention

The present invention pertains to the art of cooking appliances and, more particularly, to a microwave feed system for a toroidal waveguide in a microwave cooking appliance.

2. Discussion of the Prior Art

Cooking appliances utilizing a directed microwave energy field to cook a food item have existed for some time. In general, a cooking process is performed by directing a standing microwave energy field into an oven cavity such that the microwave energy field reflects about the oven cavity and impinges upon the food item. As the microwave energy field impinges upon the food item, the field is converted into heat through two mechanisms. The first heating mechanism is caused by the linear acceleration of ions, generally in the form of salts present within the food item. The second is the molecular excitation of polar molecules, primarily water, present within the food item. However, the nature of the standing waves results in localized areas of high and low energy which cause the food to cook unevenly. This is especially true in larger ovens where the size of the cavity requires a more uniform energy distribution in order to properly cook the food. To attain an even or uniform energy distribution, the microwave energy must be introduced into the oven cavity in a manner which creates a constructive standing wave front which will propagate about the oven cavity in a random fashion.

Various methods of directing microwaves into cooking chambers to minimize hot and cold areas within a food item have been proposed in the prior art. These methods range from altering the pattern of the standing waves by varying the frequency of the microwave energy field, to incorporating a stationary mode stirrer which simulates a change in the geometric space of the cooking chamber. Methods of changing the wave pattern include the incorporation of a rotating blade stirrer which functions to reflect microwave energy into a cooking cavity in various patterns. Traditionally, stirrers have been located at various points in the microwave feed system, ranging from adjacent to a microwave energy source, to a position within the cooking chamber itself. Some stirrers include various openings which are provided to disperse the standing waves, while others have various surface configurations designed to reflect the standing waves. Stirrers are driven either by a motor or air currents supplied by a blower. In any case, all of these methods share a common theme, i.e., to reflect and/or deflect the microwave energy into a cooking cavity such that a more uniform distribution of standing wave patterns can be achieved.

Other methods designed to achieve a more uniform distribution include modifying the structure of the waveguide itself. Waveguide designs include cylinders, square boxes, and a variety of other configurations, each having an exit window through which the microwave energy can pass. While these designs may cause the standing waves to interfere with one another such that the wave pattern is randomized, substantial energy is typically lost with such arrangements. Still other methods are directed to rotating or moving the food being cooked within the cooking chamber. In general, the food is supported on a platter which is rotated through the standing wave patterns such that the food is more uniformly exposed to the microwaves. While these methods are fine for smaller ovens, they are hardly practical for larger ovens.

As oven cavities have grown in size and microwave technology has been combined into conventional or convection ovens, the uniform distribution of the standing waves has become of even greater concern. For this reason, manufacturers have modified their designs to include multiple magnetrons, multiple stirrers, and motor driven variable speed stirrers, all of which are intended to create a random wave pattern thought to be of a more uniform character. Certainly, the mechanisms which serve to defect the microwave energy field, e.g., stirring fans and turntables, add to the complexity of these systems and introduce multiple failure points, thus reducing the service life of such appliances. Furthermore, in an age where energy consumption is of a concern, the need for an energy efficient cooking appliance is desired.

Based on the above, there still exists a need for a microwave feed or delivery system which will direct a uniform standing wave pattern into a cooking chamber in a manner that minimizes energy losses within a waveguide, while providing a uniform, maximum energy field source to the cooking chamber.

SUMMARY OF THE INVENTION

The present invention is directed to a microwave cooking appliance including a cooking chamber and a microwave energy delivery system. The microwave energy delivery system includes an annular, toroidal-shaped waveguide, a feed member, a magnetron, and a field flux generator. More specifically, the waveguide includes an upper surface, a hollow interior portion exposed to the cooking chamber, and a circular bottom surface. The feed member serves as an interface between the magnetron and the waveguide. Preferably, the feed member is constituted by a tubular section having a first end which is open to the waveguide and a second end onto which a microwave energy source, e.g. a magnetron, is mounted.

The field flux generator operates to shift the microwave energy field in the feed member to create uniform, high energy standing microwaves to be introduced into the cooking chamber. Being that the microwave energy field includes both magnetic and electrical components, the field flux generator can generate either a magnetic field or an electrical field to flux or shift the frequency of the microwave energy field. In either case, the field flux generator is operated by one of a plurality of energy sources. More specifically, the field flux generator can be operated on a pulsed DC current, a rectified AC current or a pure AC signal. Each of the energy sources evokes a different response from the microwave energy field. Actually, each of the energy sources has a different influence on the speed at which the microwave energy field reacts such that the energy sources can be matched to particular characteristics of the cooking appliance.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
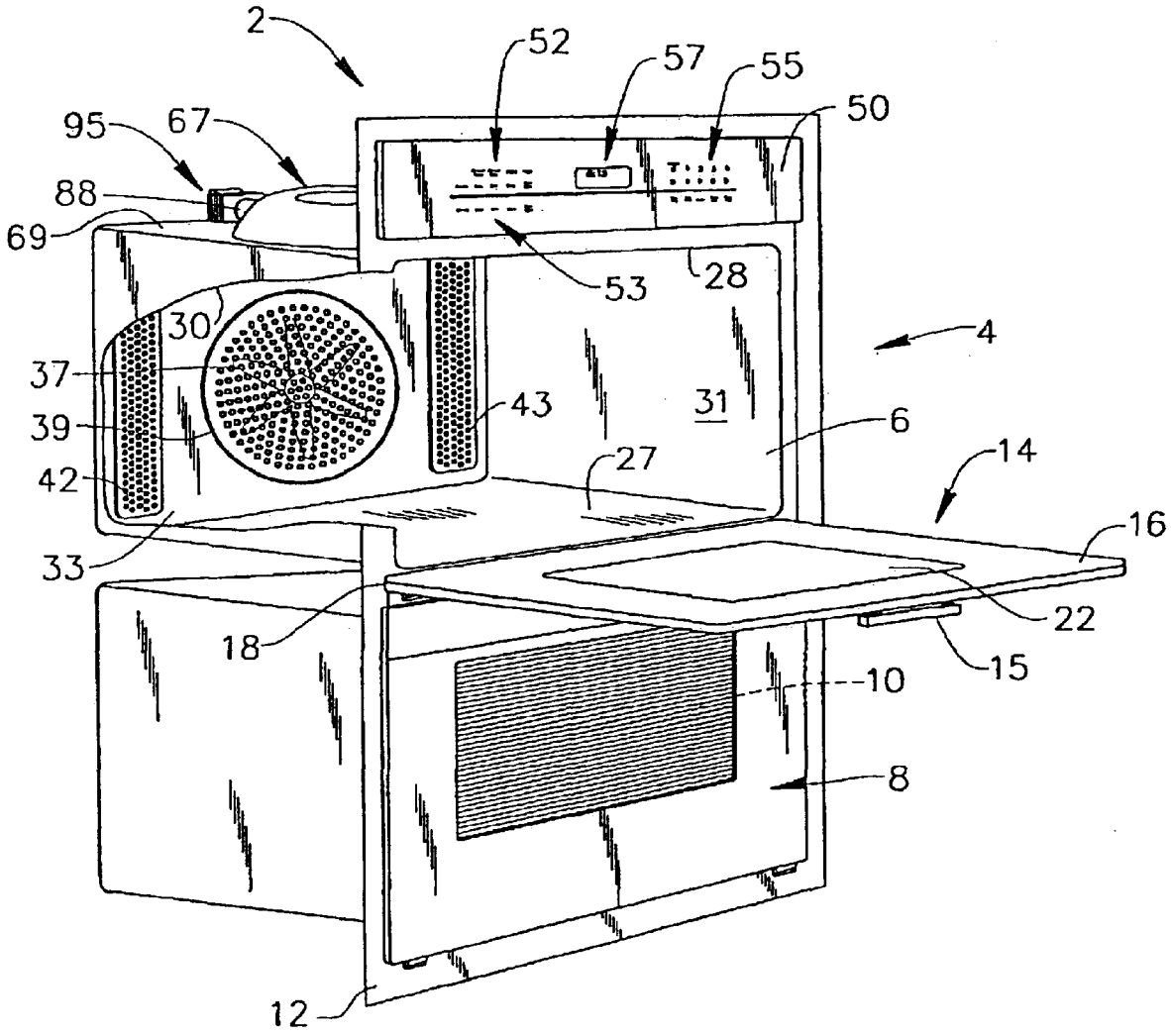
FIG. 1 is a perspective view of a combination microwave/convection wall oven including a toroidal waveguide and microwave feed system constructed in accordance with the present invention.

With initial reference to FIG. 1, a microwave cooking appliance constructed in accordance with the present invention is generally indicated at 2. Although the particular form of cooking appliance 2 can vary, the invention is shown in connection with cooking appliance 2 depicted as a wall oven. More specifically, cooking appliance 2 constitutes a dual oven wall unit including an upper oven 4 having upper cooking chamber 6 and a lower oven 8 having a lower cooking chamber 10. In the embodiment shown, upper oven 4 is adapted to perform a rapid cook or combination microwave/convection cooking process, and lower oven 8 is provided to perform a standard convection and/or radiant heat cooking operation. As further shown, cooking appliance 2 includes an outer frame 12 for supporting upper and lower cooking chambers 6 and 10. Actually outer frame 12 serves a dual purpose of supporting upper and lower cooking chambers 6 and 10, and acting as a trim piece to help seamlessly integrate cooking 2 into the kitchen decor.

In a manner known in the art, a door assembly 14 is provided to selectively provide access to upper cooking chamber 6. As shown, door assembly 14 is provided with a handle 15 at an upper portion 16 thereof. Door assembly 14 is adapted to pivot at a lower portion 18 about hinges (not shown) to enable selective access to within cooking chamber 6. In a manner also known in the art, door 14 is provided with a transparent zone 22 for viewing the contents of cooking chamber 6 when door 14 is closed.

As also shown in FIG. 1, cooking chamber 6 is defined by a bottom portion 27, an upper portion 28, opposing side portions 30 and 31, and a rear portion 33. Bottom portion 27 is preferably constituted by a flat, smooth surface designed to improve the cleanability of cooking chamber 6. In the embodiment shown, arranged on rear portion 33 is a convection fan 37 having a perforated inlet cover 39 through which heated air can be withdrawn from cooking chamber 6. Heated air is re-introduced into cooking chamber 6 through vents 42 and 43 arranged on either side of fan 37. Although cooking appliance 2 is depicted as a dual wall oven with a particular convection arrangement, it should be understood that the present invention is not limited to this model type and can be incorporated into various types of oven configurations, e.g., cabinet mounted ovens, compact microwave ovens, as well as slide-in and free standing ranges, and can employ a number of convection arrangements.

Further shown in FIG. 1, cooking appliance 2 includes an upper control panel 50 incorporating first and second rows of oven control button rows 52 and 53. Control buttons 52 and 53, in combination with a numeric pad 55 and a display 57, enable a user to establish particular cooking operations for upper and lower ovens 4 and 8 respectively. Since the general programming and operation of cooking appliance 2 is known in the art and does not form part of the present invention, these features will not be discussed further here. Instead, the present invention is particularly directed to the incorporation and construction of a microwave energy delivery system for developing and directing a microwave energy field into cooking chamber 6 as will be detailed fully below.

Figure 2:
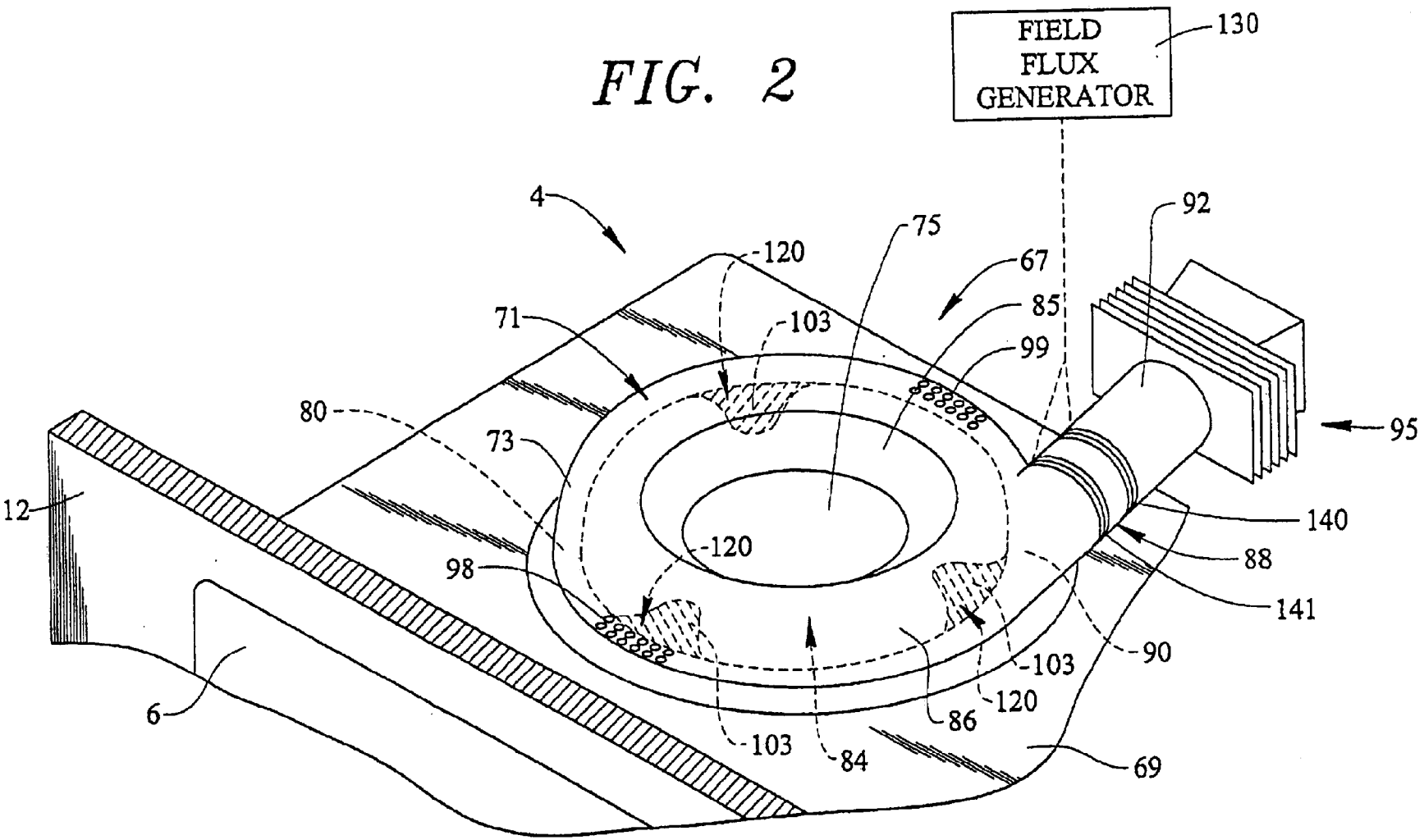
FIG. 2 is a perspective view of the toroidal waveguide and feed system of the present invention.

With particular reference to FIG. 2, a waveguide 67 is shown mounted on an exterior upper portion 69 of upper oven 4. More specifically, waveguide 67 includes an annular toroidal ring cover 71 having an outer surface 73 defining a central depression 75, and an inner bottom surface 80. In a preferred form of the invention, waveguide 67 further includes a hollow interior portion 84, defined between inner and outer walls 85 and 86, constituting a torus ring having a cross-sectional diameter and a defined centerline diameter. Waveguide 67 is preferably formed from aluminum coated steel which provides enhanced reflective qualities, while also decreasing IR emissivity. As such, energy loses due to the absorption of microwave energy are minimized. In a preferred arrangement, the cross-sectional diameter of the torus ring of waveguide 67 is set equal to ½ λ and the centerline diameter of waveguide 67 is equal to 3λ, where λ is defined as the wavelength of the microwave energy field transmitted into waveguide 67. In another preferred arrangement, the centerline diameter of waveguide 67 is equal to 6λ. In any event, magnetron 95 generates microwaves in a manner known in the art and emits the microwaves at a defined wavelength (λ), preferably 2.45 GHz. However, at this point, it should be noted that waveguide 67 and feed member 88 of the present invention is adaptable to any wavelength acceptable for cooking foods. Waveguide 67 is actually described in more detail in commonly assigned U.S. patent application Ser. No. 10/299,918 filed Nov. 20, 2002 entitled "Toroidal Waveguide For a Microwave Cooking Appliance" which is incorporated herein by reference.

As clearly shown in FIG. 2, a feed member 88 includes a first end defining an exit 90 opening into waveguide 67, and a second, terminal end 92 upon which is mounted a magnetron or microwave emitter 95. In the most preferred form of the invention, feed member 88 is constituted by a tubular section having a defined length and a circular cross-section. Preferably, the length of tubular feed member 88 is equal to an integer multiple of ½ λ. With this construction, the microwave energy field is directed through feed member 88 and aligned with the centerline diameter of waveguide 67. This particular alignment of the microwave field results in a reduction/elimination of energy reflections in feed member 88, enabling the microwave energy field to enter toroidal-shaped waveguide 67 with minimal energy loss. Moreover, as the microwave energy field enters toroidal-shaped waveguide 67, it combines with the microwave energy already present in waveguide 67 thus creating constructive wave interferences that generate additional energy modes. The additional energy modes further increase the energy directed into cooking chamber 6.

Referring further to FIG. 2, preferably arranged about a front portion of waveguide 67 are a plurality of inlet openings 98. More specifically, inlet openings 98 are positioned to allow a flow of cooling air to enter interior portion 84. Additionally, a plurality of exhaust openings 99 are arranged on a rear portion of waveguide 67, adjacent to feed member 88, to allow heated air to escape from interior portion 84. In this manner, waveguide 67 also serves as an air duct to cool interior portions of waveguide 67 and feed member 88 and, at least indirectly, magnetron 95. Inlet openings 98 and exhaust openings 99 are sized and positioned such that the reflected microwave energy field will not escape from interior portion 84.

As best seen in FIG. 2, a plurality of microwave transparent regions or openings 103 are arranged about bottom surface 80 of waveguide 67. Specifically, microwave transparent regions 103 are located about bottom surface 80 at each point where a maximum energy node will occur. As such, in the most preferred form of the invention, three equally spaced microwave transparent regions are positioned at the ½ λ points located about bottom surface 80. Cooking appliance 2 is also provided with a waveguide cover 120 arranged between bottom surface 80 of waveguide 67 and cooking chamber 6. More specifically, waveguide cover 120 is transparent to microwave energy such that the microwave energy field can pass from waveguide 67 into cooking chamber 6. In general, waveguide cover 120 is designed to withstand the highest oven operating temperatures in addition to being transparent to microwave energy. As such, microwave cover 120 can be formed from Pyrex glass, ceramic sheets, mica, silicon mica, or the like. The incorporation of waveguide cover 120 also prevents cooking byproducts, such as grease, oil, fats and the like, from entering into and damaging waveguide 67.

The above described structure has been presented for the sake of completeness and to provide a better understanding of particular aspects of the invention which are directed to a field flux generator 130 and flux field emitters 140 and 141. In accordance with the most preferred form of the present invention, field flux generator 130 operates to shift or alter the frequency of the microwave energy field prior to introduction into toroidal-shaped waveguide 67. The shift in frequency focuses and directs high energy standing waves into toroidal-shaped waveguide 67, through microwave transparent regions 103 and, ultimately, into cooking chamber 6. These high energy standing waves create a uniform cooking environment within cooking chamber 6. Actually, it has been found that the present invention achieves a uniform wave pattern with less than a one-half percent (½ %) variation, such that localized hot and cold areas in cooking chamber 6 are virtually eliminated.

In further accordance with the most preferred embodiment, field flux emitters or coils 140 and 141 are arranged along tubular feed member 88 so as to shift the microwave energy field before it is introduced into toroidal-shaped waveguide 67. In point of fact, field flux emitters 140 and 141 are preferably arranged in or about tubular feed member 88 at maxima points of the microwave energy field's sinusoidal wave pattern. To that end, the position of emitters 140 and 141 further influences the microwave energy field. By locating emitters 140 and 141 at the maxima points, the microwave energy field is focused into stronger, high energy standing wave nodes around waveguide 67. In contrast, if emitters 140 and 141 are moved away from these maxima points, the microwave energy field becomes unfocused, creating low energy standing wave nodes.

In accordance with one aspect of the invention, field flux generator 130 produces and directs a magnetic field to each of field flux emitters 140 and 141. Thereafter, each emitter 140, 141 emits a magnetic field that impinges upon and causes a slight alteration in the frequency of the microwave energy field. In accordance with another aspect of the preferred form of the present invention, field flux generator 130 produces and directs an electrical energy field to each of field flux emitters 140 and 141. In a manner corresponding to that described above, each of the emitters 140, 141 emits an electrical energy field that affects the microwave energy field. In either case, field flux generator 130 is adapted to be driven by a variety of energy sources.

That is, field flux generator 130 can be driven by a pulsed DC current, a rectified AC current or a pure AC signal. Each of the above energy sources evokes a different response from the microwave energy field, e.g., the energy sources tend to alter the speed at which the corresponding energy field reacts. Therefore, the particular manner, magnitude and speed of frequency shift can be tailored for a wide range of oven configurations. With this arrangement, food placed within oven cavity 6 will be subjected to a highly uniform, high energy, microwave energy field. The cooking operation will effect each area of the food item quite equally so that the final product will be cooked uniformly throughout. Therefore, the presence of over-cooked and under-cooked regions of the food item will be essentially eliminated.

Although described with reference to a preferred embodiment of the present invention, it should be understood that various changes and/or modifications can be made to the invention without departing from the spirit thereof. For instance, while two field flux emitters are shown in connection with the present invention, it should be understood that the number of emitters is essentially limited only by the length of the feed member. In addition, while the toroidal-shaped waveguide is shown mounted to an upper portion of the oven, other mounting arrangements, such as below, or on the rear of the oven cavity are equally acceptable. Furthermore, the feed member could have other cross-sections, such as a rectangular cross-section, while remaining within the scope of the present invention. In general, the invention is only intended to be limited to the scope of the following claims.

We claim:

1. A cooking appliance comprising:

a cooking chamber;

a toroidal-shaped waveguide including inner and outer walls, and a bottom surface which collectively define an interior portion exposed to the cooking chamber, said bottom surface including a plurality of microwave transparent regions;

a magnetron for emitting a microwave energy field having a defined wavelength directed to the toroidal-shaped waveguide;

a tubular feed member extending between the magnetron and the toroidal-shaped waveguide, said tubular feed member directing the microwave energy field from the magnetron to the toroidal-shaped waveguide; and a field flux generator including a field flux emitter arranged along the tubular feed member, said field flux generator shifting the microwave energy field prior to entry into the toroidal-shaped waveguide in order to create a uniform cooking environment for the cooking chamber.

2. The cooking appliance according to claim 1, wherein the field flux generator produces a magnetic energy field.

3. The cooking appliance according to claim 2, wherein the field flux generator operates on a pulsed DC current.

4. The cooking appliance according to claim 2, wherein the field flux generator is operated on a rectified AC signal.

5. The cooking appliance according to claim 2, wherein the field flux generator is operated on AC current.

6. The cooking appliance according to claim 2, wherein the interior portion of the toroidal-shaped waveguide includes a centerline diameter, said tubular feed member aligning the microwave energy field with the centerline diameter of the toroidal-shaped waveguide.

7. The cooking appliance according to claim 6, wherein the centerline diameter includes a length equal to three times the wavelength (3λ) of the microwave energy field.

8. The cooking appliance according to claim 1, wherein the field flux generator produces an electrical field to shift the microwave energy field.

9. The cooking appliance according to claim 8, wherein the field flux generator operates on a pulsed DC current.

10. The cooking appliance according to claim 8, wherein the field flux generator is operated on a rectified AC signal.

11. The cooking appliance according to claim 8, wherein the field flux generator is operated on AC current.

12. The cooking appliance according to claim 1, wherein the field flux generator includes a plurality of field flux emitters, each of the plurality of field flux emitters being located at a point on the tubular feed member where the microwave energy field is at a maximum.

13. The cooking appliance according to claim 1, wherein the tubular feed member includes a length equal to an integer multiple of one half of the wavelength (½ λ) of the microwave energy field.

14. The cooking appliance according to claim 1, wherein the cooking appliance is constituted by a dual wall oven.

15. The cooking appliance according to claim 1, further comprising: a waveguide cover provided between the bottom surface of the toroidal-shaped waveguide and the cooking chamber.

16. The cooking appliance according to claim 1, wherein the tubular feed member has a circular cross-section.

17. A method of introducing a microwave energy field into a cooking chamber through a toroidal-shaped waveguide comprising:

operating a magnetron to generate a microwave energy field;

directing the microwave energy field into a tubular feed member extending between the magnetron and the toroidal-shaped waveguide;

generating a field flux in the tubular feed member to shift a wavelength of the microwave energy field to establish a plurality of high energy standing microwaves; and directing the plurality of high energy standing microwaves from the tubular feed member through the toroidal-shaped waveguide into the cooking chamber to perform a cooking operation.

18. The method of claim 17, wherein generating the field flux is constituted by producing a magnetic field about the tubular feed member.

19. The method of claim 17, wherein generating the field flux is constituted by producing an electrical field about the tubular feed member.

20. The method of claim 19, wherein the step of generating the field flux is constituted by operating a field flux generator on a pulsed DC current.

21. The method of claim 19, wherein the step of generating the field flux is constituted by operating a field flux generator on a rectified AC signal.

22. The method of claim 19, wherein the step of generating the field flux is constituted by operating a field flux generator on an AC current.

23. The method of claim 17, further comprising: generating the field flux through a plurality of flux field emitters positioned along the tubular feed member.

24. The method of claim 17, further comprising: creating constructive wave interferences by combining the plurality of high energy standing microwave with a microwave energy field already in the toroidal-shaped waveguide.

* * * * *